United States Patent [19]

Bowers et al.

[11] Patent Number: 4,750,386

[45] Date of Patent: Jun. 14, 1988

[54] ENGINE AIR/FUEL RATIO CONTROLLER

[75] Inventors: William S. Bowers; Daniel J. Richardson, both of Grand Blanc, Mich.

[73] Assignee: General Motors Corporation, Detroit, Mich.

[21] Appl. No.: 902,167

[22] Filed: Aug. 29, 1986

[51] Int. Cl.[4] ..... F02D 41/06; F02D 41/08; F02D 41/16

[52] U.S. Cl. ..... 74/873; 123/478; 123/480; 123/486

[58] Field of Search ..... 74/873, 874, 872; 123/478, 480, 486

[56] References Cited

U.S. PATENT DOCUMENTS

| | | | |
|---|---|---|---|
| 3,896,913 | 7/1975 | Maruoke et al. | 74/873 X |
| 4,245,604 | 1/1981 | Lahiff | 123/478 |
| 4,290,323 | 9/1981 | Gospodar | 74/873 X |
| 4,309,759 | 1/1982 | Tokuda et al. | 123/480 X |
| 4,312,311 | 1/1982 | Iwata | 74/873 X |
| 4,416,239 | 11/1983 | Takase et al. | 123/478 |
| 4,480,620 | 11/1984 | Tauge et al. | 123/478 |
| 4,625,697 | 12/1986 | Hosaka | 123/480 X |

*Primary Examiner*—Leslie Braun
*Assistant Examiner*—Dirk Wright
*Attorney, Agent, or Firm*—Howard N. Conkey

[57] ABSTRACT

The air/fuel ratio of an engine during its open loop fuel controlled warm up period is established by one schedule while the vehicle automatic transmission is in drive and established by another schedule while the vehicle automatic transmission is in neutral.

5 Claims, 1 Drawing Sheet

ENGINE AIR/FUEL RATIO CONTROLLER

This invention relates to a system for controlling the air/fuel ratio of the mixture supplied to an internal combustion engine as a vehicle having an automatic transmission.

When a vehicle engine is first started, it is typical to provide an open loop air/fuel ratio schedule that is a function of the engine temperature until the engine has warmed up to a temperature at which the air/fuel ratio is closed loop controlled as a function of the sensed oxidizing/reducing condition of the exhaust gases. It is desirable to establish the open loop air/fuel ratio schedule so as to minimize the engine exhaust emissions while maintaining acceptable vehicle driveability.

Heretofore a single open loop warm-up air/fuel ratio schedule has been provided. However, it has been found that when the vehicle automatic transmission is in a drive transmitting condition (hereafter referred to as drive), a single air/fuel ratio schedule that establishes the minimum exhaust gas emissions while maintaining acceptable engine performance may result in the engine idle speed controller hunting or oscillating when the vehicle transmission is in a non-drive transmitting condition (hereafter referred to as neutral). If the air/fuel ratio schedule provided for a richer mixture so that the idle speed controller is stable when the automatic transmission is in neutral, the air/fuel ratio when the transmission is in drive is richer than required to provide acceptable engine performance (including at idle) resulting in excessive exhaust gas emissions.

In accord with this invention, the air/fuel ratio that is scheduled during the open loop warm up period of the engine is such as to establish minimum exhaust gas emissions and acceptable engine performance for all engine operating conditions. This is accomplished by providing two open loop air/fuel ratio schedules based on engine temperature. One schedule is provided for engine operation while the vehicle automatic transmission is in drive which establishes the minimum exhaust gas emissions while maintaining acceptable engine performance and the other schedule is provided for engine operation while the automatic transmission is in neutral which establishes a richer air/fuel ratio schedule that prevents the idle speed controller from oscillating.

Figure 1:
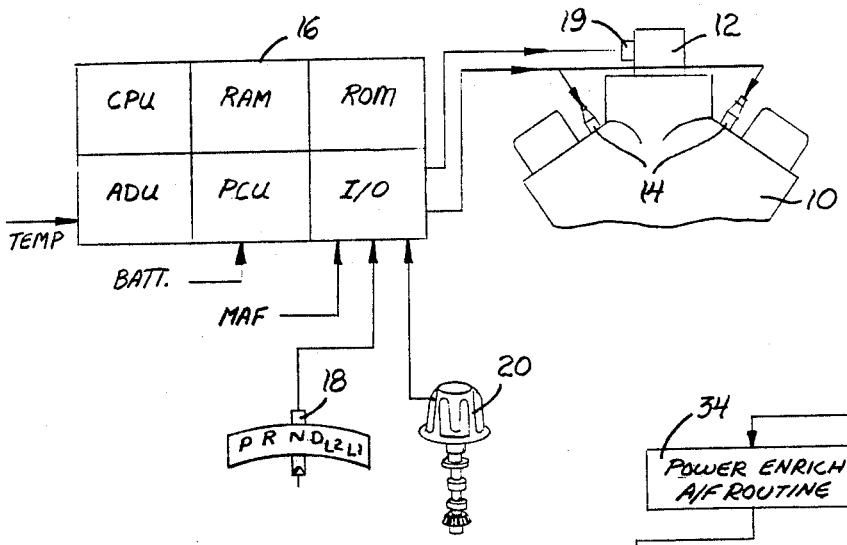
Figure 2:
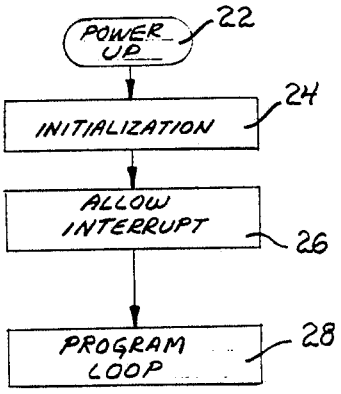
Figure 3:
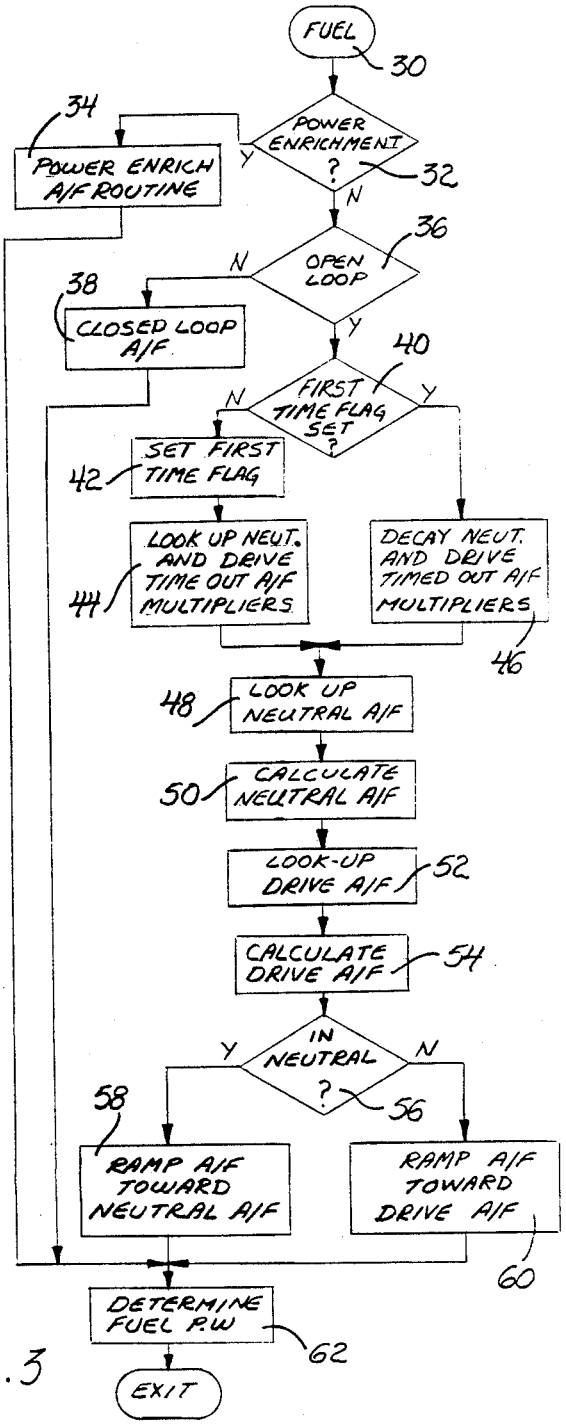

The invention may be best understood by reference to the following description of a preferred embodiment and the drawings in which:

FIG. 1 is a general diagram of an engine fuel control system that incorporates the principles of this invention; and FIGS. 2 and 3 are diagrams illustrating the operation of the system of FIG. 1.

Referring to FIG. 1, there is illustrated a vehicle internal combustion engine 10. Air is drawn into the engine intake manifold through a throttle bore 12 and mixed with fuel injected into the intake manifold by electromagnetic fuel injectors 14. The air/fuel mixture in turn is drawn into the cylinders of the engine 10 where it undergoes combustion. The byproducts of combustion are discharged through a conventional exhaust gas system not illustrated. While two fuel injectors are illustrated, it is understood that in the present embodiment a port fuel injection system is utilized wherein an injector is provided for each cylinder of the engine 10.

The injectors 14 are controlled by an engine controller 16 in response to measured values of engine parameters including mass airflow MAF into the engine 10 provided by a conventional mass airflow sensor, engine temperature TEMP provided by a conventional temperature sensor and a signal from a transmission indicator switch 18 so as to establish a predetermined scheduled air/fuel ratio. The transmission indicator switch 18 provides a two state signal one state of which indicates that the vehicle automatic transmission is in neutral and the other state of which indicates that the transmission is in drive.

The engine controller 16 takes the form of a digital computer that is standard in form and includes a central processing unit (CPU) which executes an operating program permanently stored in a read only memory (ROM) which also stores tables and constants utilized in controlling the fuel injected by the injectors 14. Contained within the CPU are conventional counters, registers, accumulators, flag flip flops, etc. along with a clock which provides a high frequency clock signal.

The computer also includes a random access memory (RAM) into which data may be temporarily stored and from which data may be read at various address locations determined in accord with the program stored in the ROM. A power control unit (PCU) receives battery voltage and provides regulated power to the various operating circuits.

The computer further includes an input/output circuit (I/O) comprised of an output section that provides a timed injection pulse to the fuel injectors 14 and a control signal to a stepper motor 19 for controlling air bypass around the throttle blade in the throttle 12 to control engine idle speed and an input section that receives a pulse output of the mass air flow sensor having a frequency representing mass air flow into the engine 10 and an output from a conventional vehicle ignition distributor 20 in the form of a reference pulse with each engine cylinder intake event. These pulses are utilized by the engine controller 16 for initiating the injection pulses to the injectors 14 and for measuring engine speed such as for idle speed control.

An analog-to-digital unit (ADU) provides for measurement of the analog signals including the signal representing engine temperature TEMP. These signals are sampled and converted under control of the CPU and stored in ROM designated RAM memory locations.

The operation of the engine controller 16 in controlling the fuel injectors 14 to establish a scheduled air/fuel ratio in accord with the principles of this invention is illustrated in FIGS. 2 and 3. Referring first to FIG. 2, when power is first applied to the system such as when the vehicle ignition switch is rotated to its "on" position, the computer program is initiated at point 22 and then proceeds to a step 24 where the program provides for system initialization. For example, at this step initial values stored in the ROM are entered into ROM designated RAM memory locations and the counters, flags and timers are initialized.

After the initialization step 24, the program proceeds to a step 26 where the program allows interrupts to occur and then to a program loop 28 which is continuously repeated. This loop includes all of the measurement, control and diagnostic routines for the engine 10 including the routine establishing the open loop air/fuel ratio in accord with this invention. Various timed intervals are established by the program loop 28 for execution of the various routines in the program loop 28.

These intervals are established by counting the output of the high frequency clock in the CPU. In the present embodiment, an interrupt is provided by the CPU at 12.5 millisecond intervals during which the fuel routine incorporating the principles of this invention is executed.

Various conventional program routines are repeatedly executed by the control unit 16 at respectively time intervals. These routines include routines for sampling the values of the various inputs, controlling spark ignition, controlling engine idle speed and for controlling the fuel via closed loop control after the engine 10 has warmed up. Since these program routines are conventional, their detail are not further described.

The routine for establishing the air/fuel ratio of the mixture supplied to the engine 10 including the open loop air/fuel ratio in accord with this invention is illustrated in FIG. 3. In general, this routine establishes the open loop air/fuel ratio of the mixture supplied to the engine 10 based on a first schedule of stored ratios as a function of engine temperature when the transmission is in neutral as represented by the output of the switch 18 and based on a second schedule of stored ratios as a function of engine temperature when the transmission is in drive as represented by the output of the switch 18. The first schedule establishes a generally richer air-fuel mixture delivered to the engine than the second schedule so as to prevent the idle speed controller from hunting or oscillating when the vehicle automatic transmission is in neutral and to establish a minimum exhaust gas emission level from the engine 10 when the transmission is in drive whereat the idle speed controller does not have a tendency to hunt or oscillate.

Referring to FIG. 3, the fuel routine executed by the engine controller 16 which determines the air/fuel ratio of the mixture supplied to the engine 10 is illustrated. The routine is entered at point 30 and then proceeds to determine which fuel delivery mode is to be executed. For illustration purposes, it is assumed that three fuel delivery modes are provided which are power enrichment, closed loop and open loop.

At step 32, the program determines if the conditions for power enrichment are present. If the conditions exist for power enrichment, the program proceeds to step 34 where the air/fuel ratio of the mixture supplied to the engine is determined by a power enrichment routine.

Returning to step 32, if the conditions for power enrichment are not present, the program proceeds to a step 36 to determine if the air/fuel ratio is to be established based on open loop control or based on closed loop control. If the condition exist for closed loop control based on parameters such as engine temperature and time after engine start, the program proceeds to a step 38 where the air/fuel ratio is set to the closed loop air/fuel ratio such as the stoichiometric ratio.

If the conditions exist for open loop control of the air-fuel mixture, the program proceeds from step 36 to a step 40 where a first time flag is sampled to determine if the program is executing the open loop air/fuel ratio routine for the first time since engine startup. This is indicated if the flag is reset, which is the state of the flag established in the initialization routine of step 24. If reset, the program proceeds to a step 42 where the first time flag is set and then to a step 44 where the program retrieves from memory a timed out air/fuel ratio multiplier value corresponding to the engine temperature at startup for when the transmission is in a drive condition. In this respect, the ROM has stored therein a predetermined schedule of air/fuel ratio multiplier values as a function of engine temperature representing a desired open loop air/fuel ratio multiplier schedule when the transmission is in a drive condition. Similarly, a timed out air/fuel ratio multiplier associated with a neutral condition of the transmission is retrieved from another table of values stored in the ROM as a function of engine startup temperature.

As will be described, the timed out air/fuel ratio multipliers have values less than unity and function to enrich the open loop air/fuel ratio for a short period immediately following engine startup. The stored schedule of multipliers associated with the neutral condition of the transmission may be smaller than the stored schedule of multipliers asociated with a drive condition of the transmission so as to provide a greater shift in the open loop air/fuel ratio in the rich direction immediately after engine start when the transmission is in a neutral condition than when the transmission is in a drive condition. In another embodiment, the two schedules of multipliers may be identical.

The multipliers obtained at step 44 are decayed to unity following engine startup upon repeated executions of the fuel routine at step 46 which follows step 40 after the first time flag was set at step 42. At the step 46, the two timed out multipliers are each decayed toward unity via first order lag equations having respective time constants that result in the multipliers attaining unity within a short period, such as thirty seconds after engine startup. The time constants may, in one embodiment, be retrieved from respective schedules of values stored in the ROM as a function of engine startup temperature.

From step 44 or step 46 after the first execution of the fuel routine following engine startup, the program proceeds to a step 48 where the program retrieves from memory an air/fuel ratio value corresponding to the last measured engine temperature for when the transmission is in a neutral condition. In this respect, the ROM has stored therein a predetermined schedule of air/fuel ratio values as a function of engine temperature representing a desired open loop air/fuel ratio schedule when the transmission is in a neutral condition. The stored air/fuel ratio values for when the transmission is in a neutral state are such that the engine idle speed controller does not hunt or oscillate. To accomplish this, the stored ratio values are generally less than that required when the transmission is in a drive condition.

At step 50, the program calculates the air/fuel ratio of the mixture to be supplied to the engine 10 when the transmission is in a neutral condition. The calculated air/fuel ratio is the ratio obtained at step 48 times the value of the neutral timed out multiplier established by step 44 or step 46. When the neutral timed out multiplier has been decayed to unity via step 46, the air/fuel ratio established by step 50 will equal the air/fuel ratio obtained at the prior step 48.

From step 50, the program proceeds to a step 52 where the program retrieves from memory an air/fuel ratio value corresponding to the last measured engine temperature for when the transmission is in a drive condition. In this respect, the ROM has stored therein a predetermined schedule of air/fuel ratio values as a function of engine temperature representing a desired open loop air/fuel ratio schedule when the transmission is in a drive condition. The stored air/fuel ratio values for when the transmission is in a drive state are generally greater than those stored for when the transmission is in a neutral state since when the transmission is in a drive state, the idle speed controller does not have a tendency to hunt or oscillate with leaner mixtures. This provides the advantage of substantially decreasing the exhaust gas emissions while yet maintaining satisfactory engine performance.

At step 54, the program calculates the air/fuel ratio of the mixture to be supplied to the engine 10 when the transmission is in a drive condition. The calculated air/fuel ratio is the ratio obtained at step 52 times the value of the drive timed out multiplier established by step 44 or step 46. When the drive timed out multiplier has been decayed to unity via step 46, the air/fuel ratio established by step 54 will equal the air/fuel ratio obtained at the prior step 52.

Next at step 56, the program determines the state of the transmission. If the transmission is in neutral, the program proceeds to a step 58 where the present value of the air/fuel ratio is ramped to the air/fuel ratio established at step 50 such as by utilization of a first order lag equation. This equation may take the form $$A/F_{new}=A/F_{old}+(A/F_{new}-A/F_{old})/K$$

where K established the time constant of the expression.

Returning to step 56, if the transmission is in drive, the program proceeds to a step 60 where the present value of the air/fuel ratio is ramped to the air/fuel ratio established at step 54 such as by utilization of a first order lag equation of the form utilized at step 58.

The ramping of the air/fuel ratio at steps 58 and 60 provide a smooth transition between the transmission neutral and drive air/fuel ratios as the transmission is shifted between the neutral and drive conditions.

From step 34, 38, 58 or 60, the program proceeds to a step 62 where the fuel pulse width required to establish the desired air/fuel ratio is determined. A signal establishing this fuel pulse width is applied to the fuel injectors 14 once for each reference pulse provided by the distributor 20 in a conventional manner to provide an air and fuel mixture having the desired ratio to the engine 10. From step 62, the program exits the fuel routine of FIG. 3.

The foregoing description of a preferred embodiment for the purpose of describing the invention is not to be considered as limiting or restricting the invention since many modifications may be made by the exercise of skill in the art without departing from the scope of the invention.

The embodiments of the invention in which an exclusive property or privilege is claimed are defined as follows:

1. A system for controlling the air/fuel ratio of the air and fuel mixture supplied to an internal combustion engine of a vehicle having an automatic transmission selectively operable between neutral and drive conditions, the system comprising:

means for sensing the temperature of the engine;

means for providing a first schedule of air/fuel ratios as a function of engine temperature, the first schedule of air/fuel ratios representing the desired temperature dependent air/fuel ratio of the mixture supplied to the engine when the transmission is in the drive condition;

means for providing a second schedule of air/fuel ratios as a function of engine temperature, the second schedule of air/fuel ratios representing the desired temperature dependent air/fuel ratios of the mixture supplied to the engine when the transmission is in the neutral condition;

means for sensing the neutral or drive condition of the transmission;

means for establishing the air/fuel ratio of the engine in accord with the first schedule of air/fuel ratios during a sensed drive condition of the transmission; and means for establishing the air/fuel ratio of the engine in accord with the second schedule of air/fuel ratios during a sensed neutral condition of the transmission.

2. The system of claim one wherein the temperature dependent air/fuel ratios in the first schedule of air/fuel ratios are leaner than the temperature dependent air/fuel ratios in the second schedule of air/fuel ratios for corresponding sensed temperatures of the engine.

3. A system for establishing the warm up air/fuel ratio of the air and fuel mixture supplied to an internal combustion engine of a vehicle having an automatic transmission selectively operable between neutral and drive conditions, the system comprising:

means for sensing the temperature of the engine;

first memory means for storing a first schedule of air/fuel ratio values corresponding to respective engine temperature values, the first schedule of air/fuel ratio values representing the desired temperature dependent air/fuel ratios of the mixture supplied to the engine when the transmission is in the drive condition;

second memory means for storing a second schedule of air/fuel ratio values corresponding to respective engine temperature values, the second schedule of air/fuel ratio values representing the desired temperature dependent air/fuel ratios of the mixture supplied to the engine when the transmission is in the neutral condition;

means for sensing the neutral or drive condition of the transmission;

means for (A) retrieving the air/fuel ratio value corresponding to the sensed temperature of the engine from the first memory means in response to a sensed drive condition of the transmission and (B) retrieving the air/fuel ratio value corresponding to the sensed temperature of the engine from the second memory means in response to a sensed neutral condition of the transmission; and means for adjusting the air/fuel ratio of the mixture supplied to the engine in accord with the retrieved air/fuel ratio value.

4. The system of claim 3 wherein the means for adjusting the air/fuel ratio comprises means for ramping the air/fuel ratio of the mixture supplied to the engine toward the retrieved air/fuel ratio.

5. A system for establishing the warm up air/fuel ratio of the air and fuel mixture supplied to an internal combustion engine of a vehicle having an automatic transmission selectively operable between neutral and drive conditions and having an engine idle speed controller having a tendency to oscillate at high values of the warm up air/fuel ratio of the mixture supplied to the engine when the transmission is in its neutral condition, the system comprising:

means for sensing the temperature of the engine;

first memory means for storing a first schedule of air/fuel ratio values corresponding to respective engine temperature values, the first schedule of air/fuel ratio values representing desired high values of warm up temperature dependent air/fuel ratios of the mixture supplied to the engine when the transmission is in the drive condition so as to minimize exhaust gas emissions from the engine;

second memory means for storing a second schedule of air/fuel ratio values corresponding to respective engine temperature values, the second schedule of air/fuel ratio values representing desired low values of warm up temperature dependent air/fuel ratios of the mixture supplied to the engine when the transmission is in the neutral condition so as to prevent oscillations of the idle speed controller;

means for sensing the neutral or drive condition of the transmission;

means for (A) retrieving the air/fuel ratio value corresponding to the sensed temperature of the engine from the first memory means in response to a sensed drive condition of the transmission and (B) retrieving the air/fuel ratio value corresponding to the sensed temperature of the engine from the second memory means in response to a sensed neutral condition of the transmission; and means for adjusting the air/fuel ratio of the mixture supplied to the engine in accord with the retrieved air/fuel ratio value.

* * * * *